US007752965B2

(12) United States Patent
Atwater et al.

(10) Patent No.: US 7,752,965 B2
(45) Date of Patent: Jul. 13, 2010

(54) PRINTING PRESS INKING SYSTEMS

(75) Inventors: Richard G. Atwater, Rockford, IL (US); Clifford Eighmy, Loma Linda, MO (US)

(73) Assignee: Controls Group Incorporated, Rockford, IL (US)

( * ) Notice: Subject to any disclaimer, the term of this patent is extended or adjusted under 35 U.S.C. 154(b) by 0 days.

(21) Appl. No.: 11/758,095

(22) Filed: Jun. 5, 2007

(65) Prior Publication Data

US 2008/0302260 A1 Dec. 11, 2008

(51) Int. Cl.
*B41F 31/02* (2006.01)

(52) U.S. Cl. ..... 101/366; 101/365

(58) Field of Classification Search ..... 101/366; 417/349, 326, 415, 462, 212, 218
See application file for complete search history.

(56) References Cited

U.S. PATENT DOCUMENTS 3,940,782 A 2/1976 Neeb et al.
5,472,324 A 12/1995 Atwater
5,482,448 A 1/1996 Atwater et al.
5,526,745 A * 6/1996 Uera ..... 101/366
6,336,405 B1 * 1/2002 Kawata et al. ..... 101/480
6,732,647 B2 * 5/2004 Uera et al. ..... 101/366
6,810,805 B1 11/2004 Atwater
2003/0116043 A1 6/2003 Uera et al.

OTHER PUBLICATIONS

International Searching Authority/US, International Search Report and Written Opinion of the International Searching Authority, Nov. 7, 2008.

* cited by examiner

*Primary Examiner*—Judy Nguyen
*Assistant Examiner*—Leo T Hinze
(74) *Attorney, Agent, or Firm*—Vedder Price P.C.

(57) ABSTRACT

A series of pumps for precise metering of ink to all zones of a web press. One set of the ink pumps is operated by a set of motors, one motor for every two zones. The motors are reversible, preferably with a toothed belt driving each pump. The other units include one motor for each pump, with the motor driving a shaft which drives a link arm, the link arm driving a pivot shaft with a variable stroke, ranging from zero to a full output. The link arms are driven individually or as a group, and each has its own stroke. In one case, the pivot shafts are operated by link arms which can be in or out of phase with each other. In another case, an eccentric on the drive shaft can be adjusted to produce a variable stroke of the link arms and the pivot shafts.

13 Claims, 8 Drawing Sheets

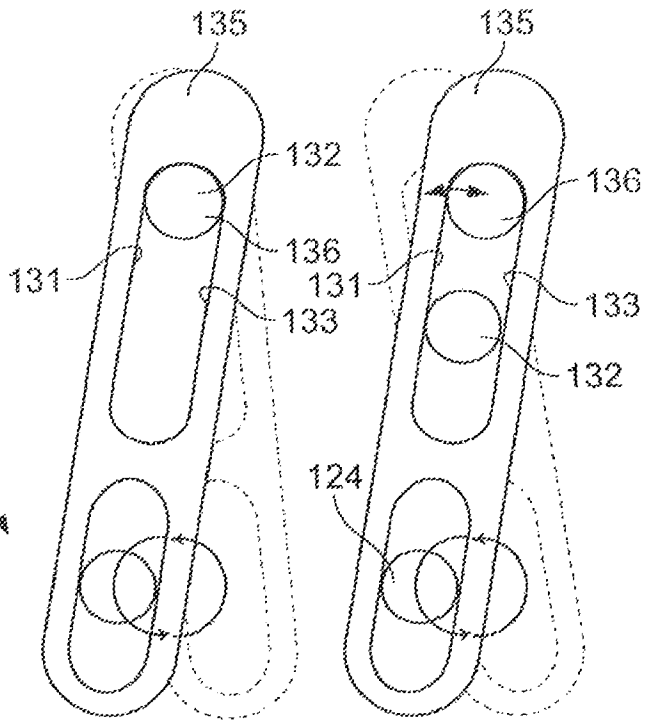
FIG. 4B
FIG. 4A
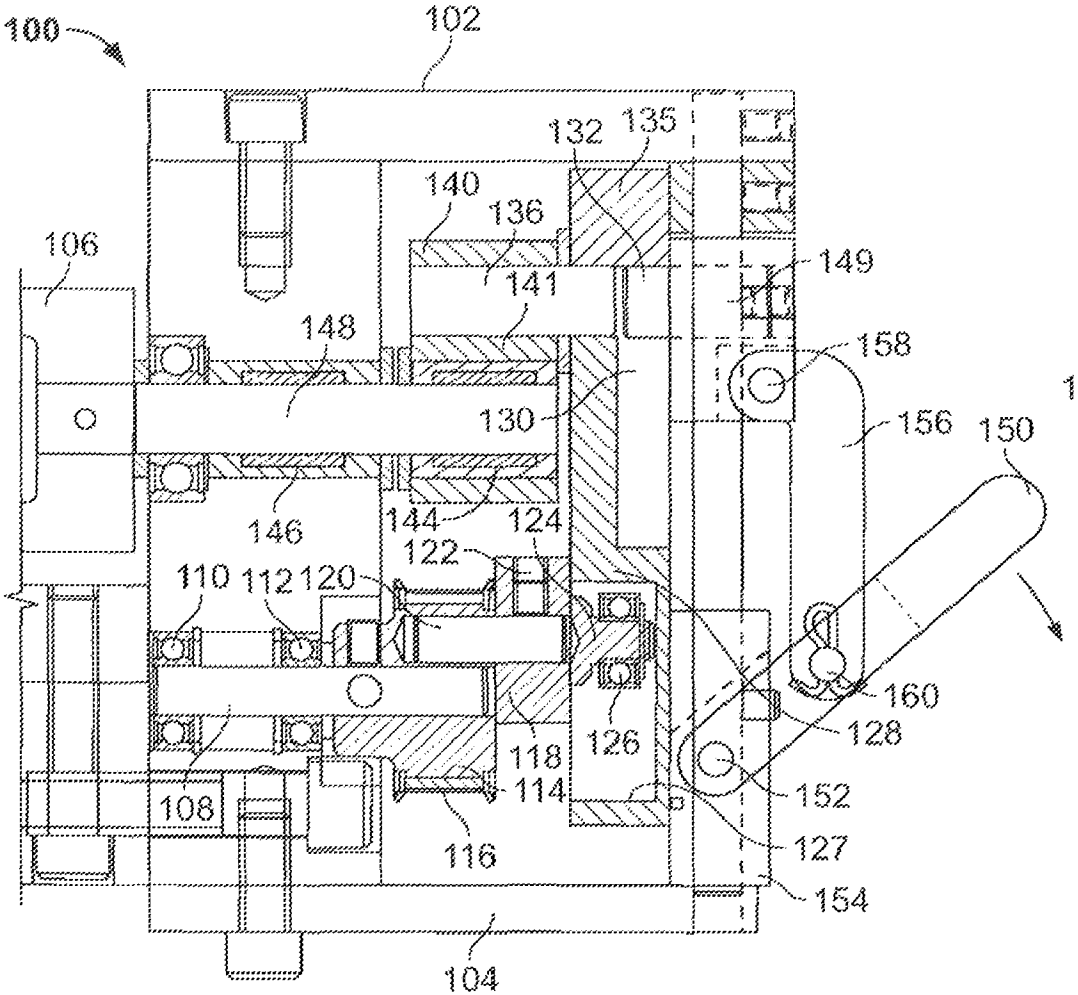
FIG. 4

PRINTING PRESS INKING SYSTEMS

BACKGROUND OF THE INVENTION

The present invention relates to inking systems for web printing presses, and more particularly, to several improved systems for operating the rotary ink pumps which are used in such presses.

For example, a typical press may include 24 ink pumps which operate to print twenty-four zones. Each pump supplies the ink to one zone of printing, and as a consequence, the ink pumps are fairly closely spaced apart from each other. Because the requirements for printing mean that any one zone may have the same, similar, or quite different ink requirements than any other zone, the ink pump system must accommodate these different requirements. The ink pumps used in these presses are rotary pumps, for example, of the type described in U.S. Pat. No. 5,482,448, issued Jan. 9, 1996. A different ink pump is also shown in U.S. Pat. No. 5,472,324, issued Dec. 5, 1995. Either kind of pump, or other kinds of pumps, may be used with the drive systems described. The contents of both of these patents are hereby incorporated fully herein by reference.

The novel features of the present invention include the manner in which these ink pumps are driven. This manner and the structure of the various drive mechanisms are contained in, and set out more fully in, the following detailed description. Several different mechanisms are described in detail, but they all have in common the fact that there is generally a stop-start or intermittent rotary motion of the pumps. The input varies, but includes rotary or oscillatory motion. The different mechanisms all include an amplitude adjustment which then results in a variable angular displacement of the shafts of the ink pumps.

In one case, which involves two pumps, the variable stroke motion is achieved by a single, bidirectional stepper motor and a pair of overrunning clutches for each ink pump. In this first embodiment, there are a pair of pumps which are driven by a novel drive mechanism. The pumps are arrayed in pairs but the two pumps are driven in an opposite hand of rotation by a stepper motor and two drive shafts.

The stepper motor operates the two shafts, one in a first direction and the second in an opposite direction, with variable angular displacement. This is accomplished by positioning the overrunning clutches in an opposite sense, with one of the clutches being placed in one driving mechanism while the opposite one is driven by a clutch operating in a different direction. In both cases, these are two overrunning clutches for each shaft, a dynamic clutch and a holding clutch. The holding clutch always maintains pressure on the pump drive, because the ink must be held under pressure as soon as the piston completes its stroke.

This construction has the advantage of using only one motor for two pumps, and besides energy savings and related advantages, this enables the motors to be closely spaced apart so the pumps can likewise be spaced closely apart. Thus, in a 24-pump application, there need be only twelve motors.

In all applications, there is also a dynamic overrunning clutch and a holding clutch which is used during the reset period of the shaft. The pistons pump ink in one direction only so each pump shaft is driven in only one direction. In all of the constructions, the angular displacement over time of the pump drive shaft is varied to change the rate at which the ink is delivered.

It is therefore an object of the present invention to provide a series of mechanisms which, although differing somewhat in the manner in which they operate, have the same or approximately the same way of driving the shaft(s) of the ink pump.

Another object of the present invention is to provide a bidirectional stepper motor which steps or operates in two different directions, and hence a single motor can be used to drive two ink pumps, thereby reducing by half the number of motors used.

A further object of the present invention is to use a novel means for driving paired ink pumps, one of which rotates in one direction and the other which rotates in the opposite direction.

A still further object of the invention is to provide a drive for plural ink pumps, each one of which contains two clutches in the drive shaft mechanisms, with one being a dynamic clutch which allows the drive shaft to move in a certain rotary position, and a holding clutch preventing the drive shaft from rotating backwards under the accumulated pressure.

A further object is to provide a series of novel constructions for operating ink pumps having a pair of pump elements concentrically arranged within a ported sleeve, with both of the elements operating to provide a full cycle of ink being pumped.

Another object is to provide several novel systems and arrangements for driving rotary ink pumps.

A still further object of the invention is to provide a stepper motor which will drive two sprockets, one in each direction, and which can have the same or completely different driving "information" for each direction of rotary displacement.

A further object of the invention is to provide an ink pump system wherein a single pump drives a pair of pump snails by means of a toothed belt or the like.

A still further object of the invention is to provide a plurality of different pump drive mechanisms, wherein an intermittent rotary motion is provided in one direction for the pump shaft.

A further object is to provide a mechanism for converting the rotary motion on the belt or other drive means to an intermittent rotary motion by changing the amplitude of the intermittent motion which rotates the drive shaft.

Another object is to provide a mechanism wherein the primary drive comes from a motor driving a reciprocating drive rod, with the reciprocating drive rod providing the motion for a series of ink pumps.

Another object is to provide a mechanism wherein there are three shafts required so as to achieve unidirectional rotary motion in the first and third drive shafts, and wherein the second shaft can be made to undergo a slightly aphasia motion for the output shaft.

Another object is to provide a pump drive system which includes three shafts, with the difference in angular position of the first and third shafts used to provide an intermittent movement of the second shaft such that, when the two shafts are in phase, the center shaft will not move but when they are out of phase, the center shaft undergoes a swinging intermittent motion which is imparted to the pump drive shafts.

A still further object of the invention is to provide a drive system which is operated by belts or pulleys and in which a bifurcated drive shaft is used, with the shaft being off settable equally at the top and bottom with the consequent neutralizing of the offset. In this construction, the pump drive also has a pair of one-way clutches.

Another object is to provide a drive yoke with the centerline of a threaded shaft being equally offset from the circular locus of the groove, thereby neutralizing the offset.

SUMMARY OF THE INVENTION

The present invention achieves its objects, and other inherent objects by providing a number of constructions, each of which uses a pair of concentrically arranged pump elements, driven by various constructions featuring intermittent pumping strokes and each having dynamic and holding clutches to allow the pumping motion and preventing the pumps from releasing their bold on the pump shafts.

The exact manner in which these objects and other objects and advantages are achieved in practice will become more apparent when considered in conjunction with the following detailed description of the invention and shown in the accompanying drawings in which like reference numbers indicate corresponding parts throughout.

BRIEF DESCRIPTION OF THE DRAWINGS

FIG. 4 shows a different sort of pump from FIG. 1-3 and illustrates a belt driven mechanism which is manually adjustable under the control of an operator, and which includes a dynamic clutch and a locking clutch, as well as an adjusting lever for changing the stroke of the link pin, and showing the link arm in a zero output position;

FIG. 4A is a view of the link arm of the embodiment of FIG. 4, and showing the link arm in an idling or zero output position, wherein the link pin is aligned with the pivot shaft;

FIG. 4B shows the pivot moved down, causing the upper end of link arm to undergo a swinging motion;

DESCRIPTION OF THE PREFERRED EMBODIMENTS OF THE INVENTION

As will be noted from the following description, the invention may be practiced in a number of different ways, including those described in detail, and also with variations and changes being made to the described embodiments.

Figure 1:
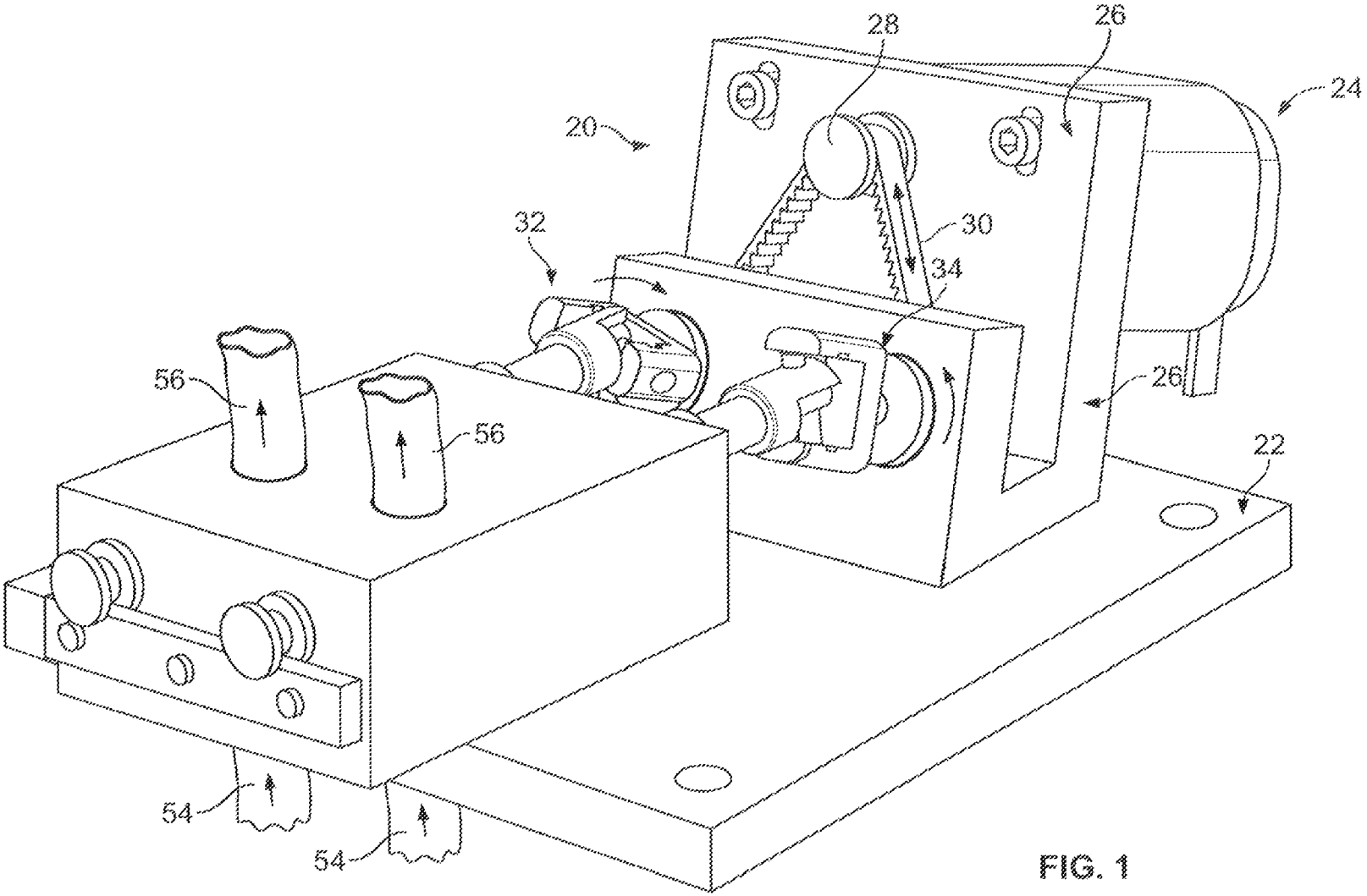
FIG. 1 is a perspective view of an ink pump wherein a single stepper motor operates through a belt to drive two shafts in opposite directions, and showing the ink pump inlets at the bottom and outlets at the top of the block containing the ink pumps.
Figure 2:
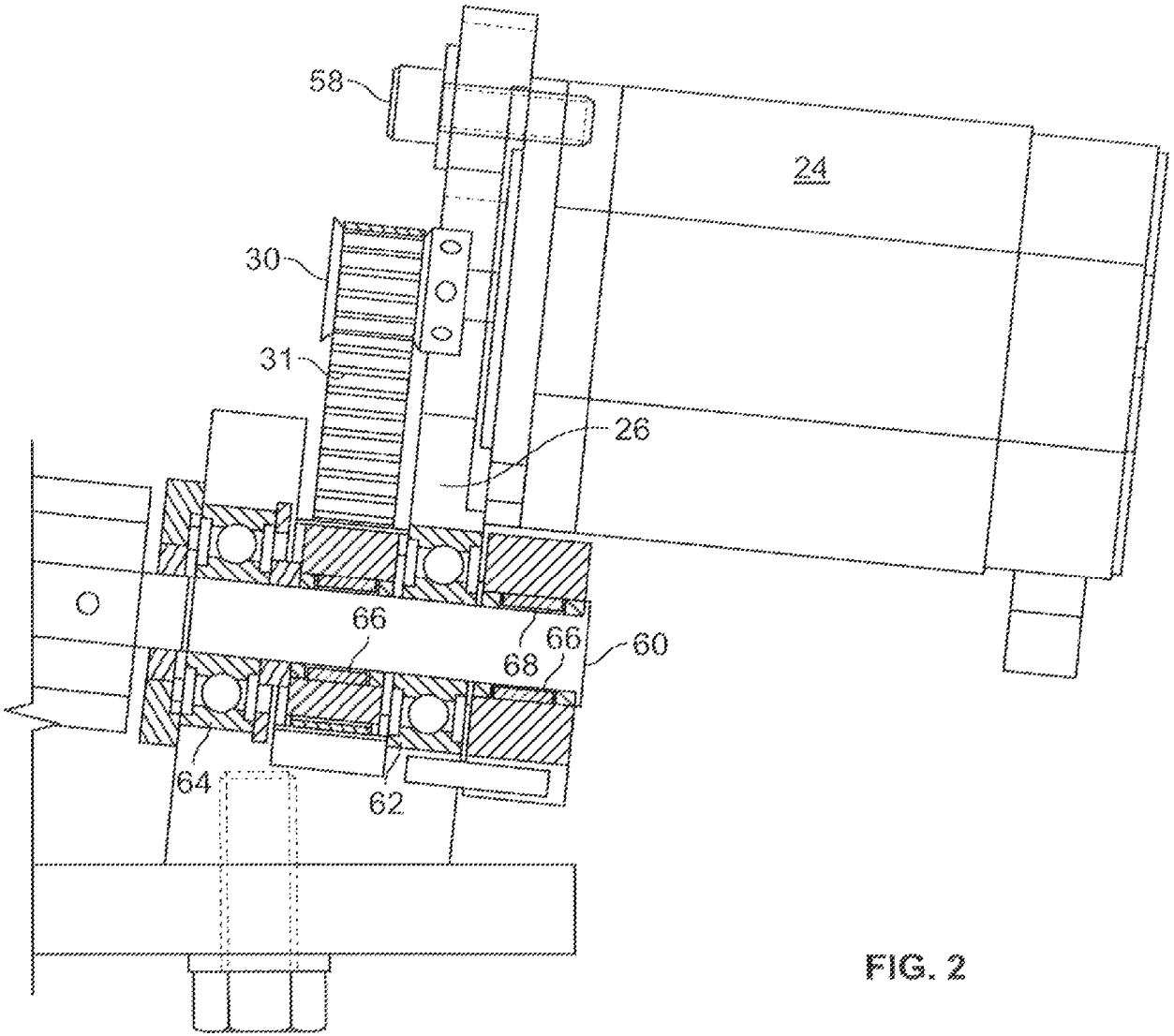
FIG. 2 is a partial vertical sectional view of the pump drive stepper motor, a drive pulley, a belt, and one part of the pump drive shaft, the view also showing a pump drive shaft, a locking clutch and a dynamic clutch.
Figure 3A:
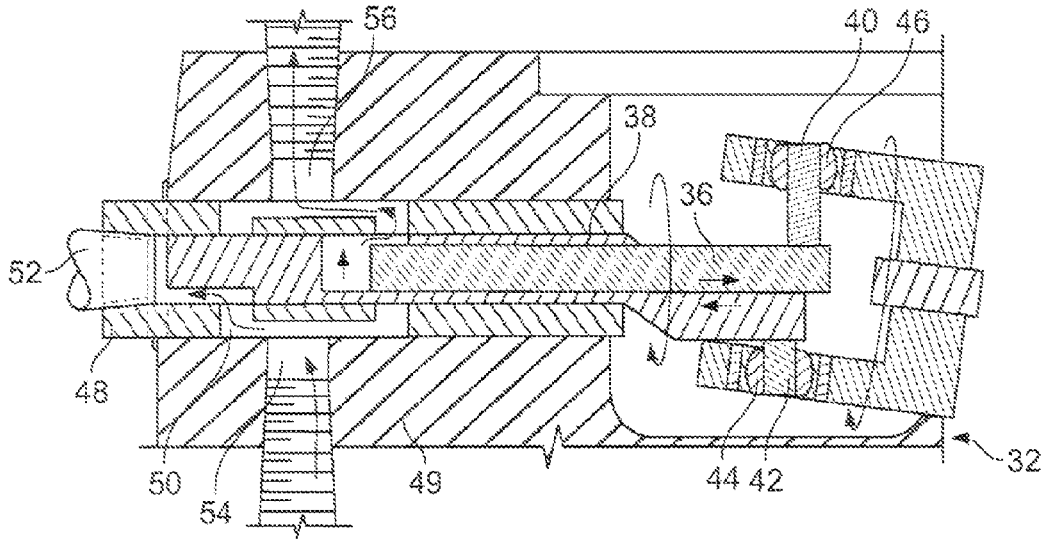
FIG. 3A is a vertical sectional view of a housing, a ported sleeve, and two concentric pistons of the ink pump of the invention, showing the outer concentric element of the pump drawing ink from the reservoir and inner concentric element of the pump pushing the ink toward the pump outlet.
Figure 3B:
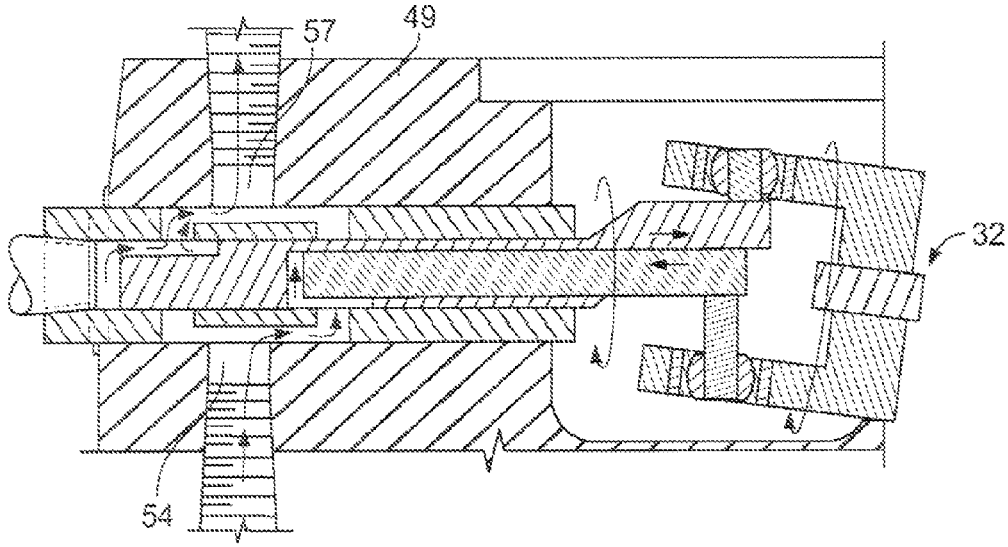
FIG. 3B shows the same sort of ink pump but showing the movable elements in a different position.

Referring now to the drawings in greater detail, and in particular to FIGS. 1-3, there is shown an ink pump and drive apparatus generally designated 20, including a base plate generally designated 22 for supporting a motor generally designated 24. The apparatus 20 includes a motor mount generally designated 26, a drive sprocket 28 and a toothed drive belt 31. A pair of yokes generally designated 32, 34 are provided for inner and outer pistons 36, 38 (FIG. 3A, 3B).

The pistons 36, 38 are driven by pins 40, 42 which are received in spherical bearings 44, 46 within the yokes 32, 34. The pistons 36, 38 ride within an apertured cylindrical liner generally designated 48 lying inside the block 49. This largely defines the spaces 50 for the pistons 36, 38. The end of this central passage 50 is defined by a plug 52. There are provided individual inlet and outlet passages 54, 56, one for each of the pistons 36, 38.

Referring now in particular to FIG. 2, there is shown the motor 24 and, somewhat schematically, a mounting screw 58, and showing the toothed driving belt 31 trained over the sprocket 30. The shaft 60, which serves to drive the yoke 32, is journaled on a pair of bearings on 62, 64 and these are spaced from the housings 65, 67, which provide support for the dynamic overrunning clutch 66 and the holding clutch 68.

As will be noted, in particular reference to FIG. 1, the motor 24 is a digital stepping motor, customarily having 300-400 steps or movements per revolution. Motors such as this type may be energized for motion in either direction, and therefore, assuming that there are pulses sending, say 5 notches or increments of movement to be sent in one direction and two notches or increments to be sent in the other direction, then the pumps would be correspondingly energized to make four or five increments in one direction and two increments in another direction. Thus, either yoke may be called upon to run any number of pulses up to its limit and the other may not see any or may see any number, including a large number, in opposition to the first direction.

The pistons are of a type shown in U.S. Pat. No. 5,482,448 and accordingly, their operation need not be described in detail. However, it will be noted that the pistons draw ink from below and operate to pump it out of the passages above. By arranging the two pistons and sleeves 48 in the proper phased relationship, one piston is pumping ink while the other piston is withdrawing the ink from the feed passage 54.

After the first piston 38 has rotated to the bottom position, the other piston 36 is registering with the port at the top, and continues pumping ink into the passage 49. Thus, any yoke movement causes one piston or the other to pump ink, and accordingly the ink pumps are operative at all times that the yoke moves. The overrunning clutches serve the purpose of allowing the motion to be transmitted in one direction only, with the holding clutch 68 holding the shaft 60 after the dynamic clutch 66 has positioned the shaft 60. Consequently, there is no time at which the shaft is allowed to rotate backwards, as would be the case without the clutches and with fairly strong pressures downstream of the pump.

Referring now to FIGS. 4, 4A, 4B, 4C and 4D, another embodiment of the invention is shown. Whereas this embodiment preferably uses the identical ink primps to those described above, the remaining portion includes unidirectional motors rather than bi-directional motors, thus substantially reducing the cost.

In this embodiment there is a frame unit generally designated 100, which includes an upper member 102, lower member 104 and yoke 106 which drives the pistons in the pump. This embodiment uses a jack shaft 108 journaled in bearings 110, 112 and serving to locating a drive pulley 114, which is affixed to the jack shaft 108. The drive pulley 114 includes a drive belt 116 causing rotation of the pulley 114. In addition, when the pulley 114 rotates, the rotary member 118, which is held in place by a set screw on a stub shaft 120, also rotates.

The stub shaft 120 includes a driving pin 124 and a driving bearing 126. Consequently, when the drive pulley 114 rotates, the rotary member 118, the bearing 126 and the driving pin 124 all describe a circle (FIGS. 4A, 4B) about the jack shaft 108. The rotary driving pin 124 and bearing 126 trace a circle while engaging the lower end 127 of the link arm. This drives the lower end of the link arm in a back and forth motion. The link arm will undergo a motion dictated by the position of the fulcrum 132. The pocket 130 in the link arm, and its sides 131, 133 engages the variably positioned link arm 132.

The uppermost portion of the link arm 128, does not undergo any significant movement, as long as the fulcrum 132 or link pin is coincident with the pivot shaft 136 (FIG. 4, 4A). However, when the fulcrum or the link pin 132 is moved downwardly as shown in FIG. 4B in the drawing, the upper end 135 of the link arm 128 and the pivot shaft 136 will begin to oscillate, to a degree which depends on the position of the fulcrum or link pin 132. When the pivot shaft 136 moves back-and-forth, the upper end 140 of the housing also undergoes a degree of back and forth movement, depending on the degree to which the fulcrum 132, 141 is offset from the axis of the pivot shaft 136. The overrunning clutches 144, 146 operate to allow the drive shall 148 to move intermittently in one direction only, and the yoke 106 is therefore driven intermittently in one direction as well.

Adjustments can therefore be made according to the amount of ink desired to be pumped. Moving the fulcrum or link pin 132 is accomplished by moving the link pin carrier 149 downwardly from the position shown in FIG. 4, and this is done by pulling on the control lever 150, which is pivotally mounted at 152 to the base plate 154. The lever 150 will move the control arm 156 which is mounted at its ends 158, 160 to the carrier 149 and to the base plate 154.

Figures 4C, 4D, 5:
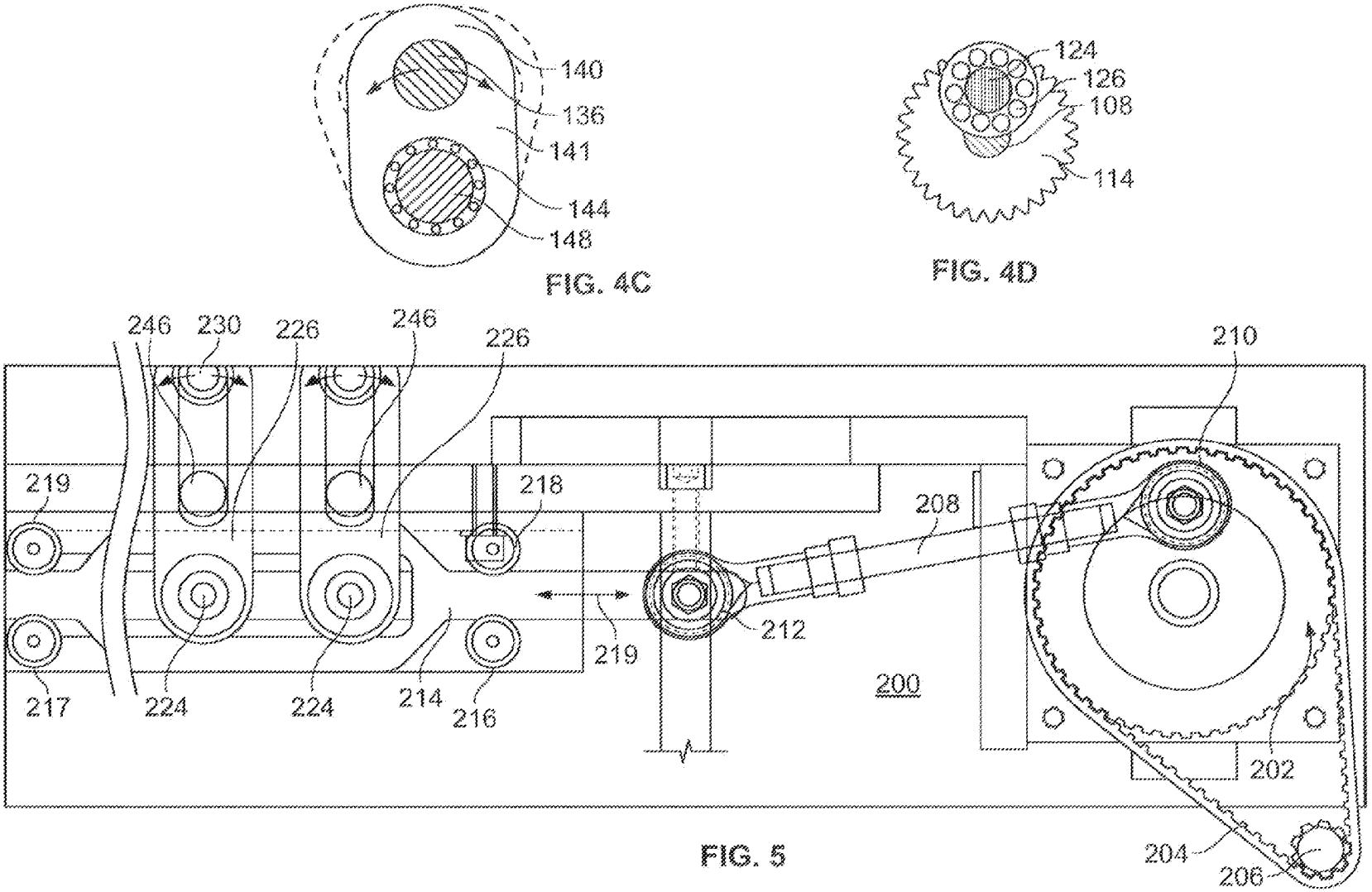
FIG. 4C is a vertical sectional view of the pivot shaft and drive shaft of the invention, with a clutch surrounding the drive shaft and showing both parts in a pivot shall housing.
FIG. 4D is a front view of the drive pin and bearing for the link arm, showing the teeth of the belt drive and the other features of the invention.
FIG. 5 is a side elevational view showing a drive mechanism having a belt-driven sprocket, a connecting rod, a wrist pin, and a pair of guides for the link arm.

FIG. 4C shows that when the pivot shaft 136 moves back and forth, the drive shaft 148 remains in its fixed position, but moves angularly about its own axis in a series of intermittent movements. The clutches 144, 146 allow one-way movement only.

FIG. 4D shows the drive pulley 114, the jack shaft 108, the driving pin 124 and the bearing 126.

The illustrations of FIG. 4 show that the volume of the ink flow can be adjusted manually, but a motor can also be used to control the exact amount of ink flow desired.

Referring now to FIGS. 5-7B, there is shown an embodiment of the invention which differs in several respects from the one described above. Here, the ink pump assembly of the invention is shown to include a frame unit 200, a toothed wheel generally designated 202 and driven by a belt trained over a pinion gear 206. This toothed wheel 200 in turn drives a connecting rod 208. The connecting rod 208 includes, at the big end, a bearing 210, and at the other end, a wrist pin 212. The wrist pin 212 connects to a slide unit 214. The slide 214 is kept, aligned by a first set of rollers 216, 218 lying toward the connecting rod 208 as well as another pair 217, 219 at the remote end, which hold it aligned, so that the slide unit 214 operates strictly in a back-and-forth, one-dimensional mode.

Figure 6:
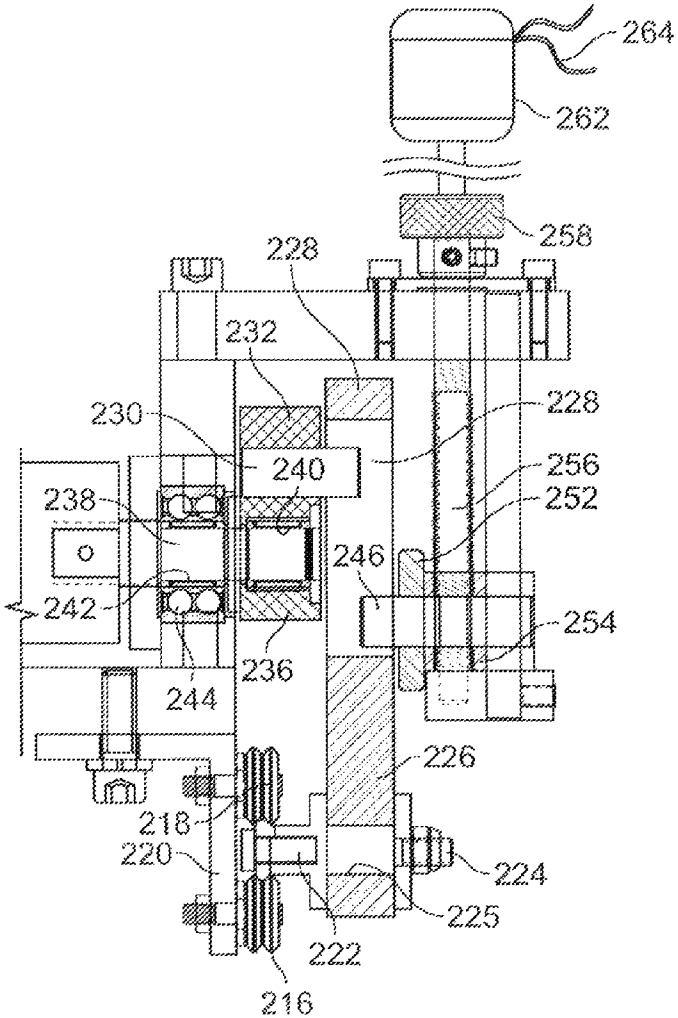
FIG. 6 is a vertical sectional view of the mechanism of FIG. 5, and showing the driving pin, the link arm, the link pin, the pivot shaft and the drive shaft and other features of the invention, including the stroke adjustment mechanism which could be manually operated or motorized.

Referring now in particular to FIG. 6, there is shown in addition to the guide rollers 216, 218, a mount 220 for the guide rollers, a locating bolt 222 passing through an opening 225 in the lower part of the link arm 226. The bolt 222 is held in place by a nut 224. An upper portion 228 of the link arm 226 accommodates a pivot shaft 230, which extends outwardly from the shaft housing 232 and into the opening 234 in the link arm 226.

The pivot shaft housing 232 has its lower portion 236 affixed to the drive shaft 238 via a pair of overrunning clutches 240, 242. Ball bearings 244 locate the drive shaft 238.

The fulcrum 246 rides on the inner surfaces 248, 250 of the opening 234. The position of the fulcrum 246 or link pin depends on the position of the nut 252 which is carried by the holder 254 and in turn is threadedly attached to the adjusting screw 256 which is operated by a knurled handle 258.

Figure 7B:
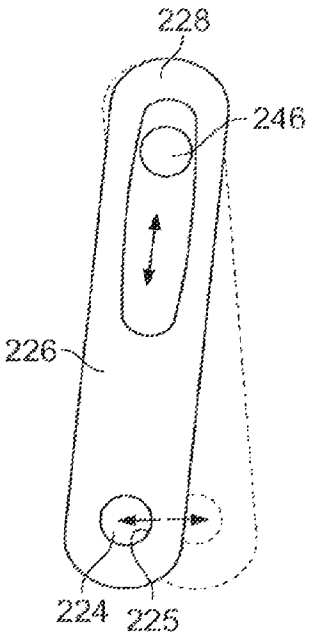
FIG. 7B shows the link arm of FIG. 7A in a different position.
Figure 7A:
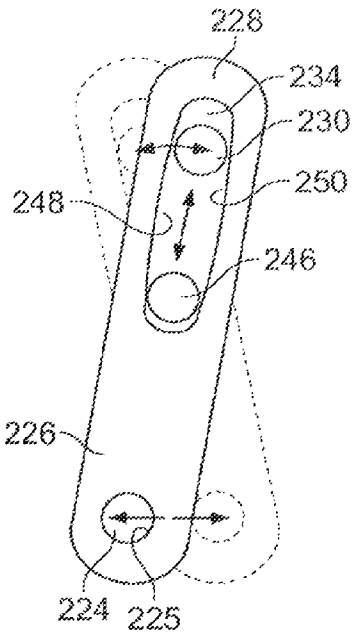
FIG. 7A is a front view showing s swinging movement of the link arm which has been adjusted for a large swinging movement of the link arm.

The functioning of this unit, in other words, the movement of the crankshaft 238 depends on the position of the fulcrum or link pin 246. With the link pin 246 in its farthest removed position from the pivot shaft 230, the link arm behaves as shown in FIG. 7A, that is, the link arm 226 now pivots about the fulcrum 246 as the nut 224 moves back and forth, thus moving the pivot shaft 230 from left to right and back, with an intermittent motion. This in turn drives the crankshaft 238 around by steps, because of the clutches 240, 242.

By manipulating the knurled handle, the fulcrum may be moved vertically to any degree desired, up to and including moving it coincident with the pivot shaft 230. As shown in FIG. 7B, this causes the back and forth motion of the link arm 226 to be totally neutralized, or in other words, reducing the motion of the pivot shaft 230 to zero.

FIG. 6 also shows an optional motor 262 with power wires 264 leading to it. This illustrates one way in which the adjustment can be made other than manually.

Figure 8:
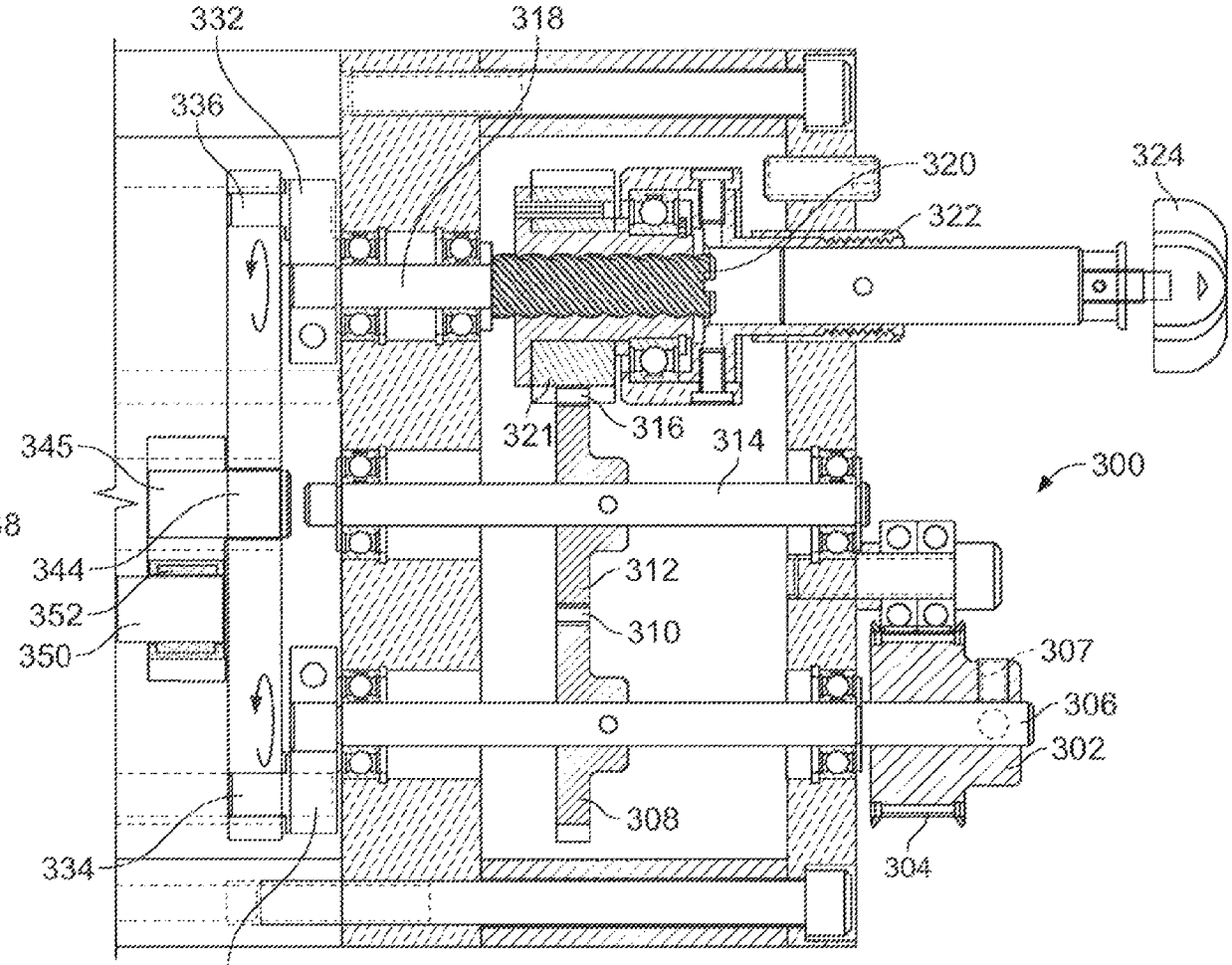
FIG. 8 is a vertical sectional view showing an embodiment with three shafts connected by gears and a screw adjustment mechanism for moving the link arm in and out of phase, and thereby causing movement of the link arm and movement of the pivot shaft.
Figure 9:
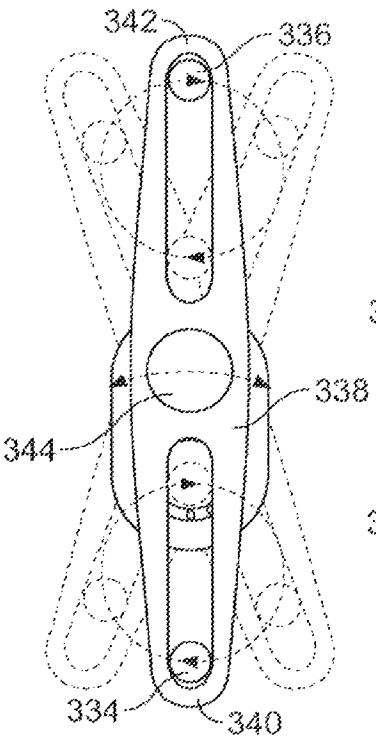
FIG. 9 shows the link arm in its various positions.

FIGS. 8 and 9 show a still different form of construction which falls within the scope of the invention. Here, in FIGS. 8 and 9, there is shown an assembly generally designated 300 which includes a drive gear 302 driven by a drive belt 304, in which in turn drives a first power shaft 306 to which it is fastened by a key 307. The shaft 306 contains a gear 308 which in turn has teeth 310 and consequently, drives gear 312 and also an idler shaft 314. The gear 312 on the idler shaft 314 engages another gear 321 on a third shaft 318. Consequently, there are always provided in this embodiment three shafts, with shafts 306 and 318 rotating in the same direction. The gears mesh with each other as shown at 310 and 316. However, there is space for limited axial movement of the threaded portion 320 of the gear 321 as shown.

FIGS. 8 and 9 show that there is a shaft extension 330, 332 on each of the shafts 306, 318. The shaft extensions each have a drive pin 334, 336 on them, and the drive pins 334, 336 engage the link arm 338 near the ends 340, 342 of the link arm, while the opening 344 in the center of the link arm 338 engages the pivot shaft 345, and will not move, as long as the drive pins remain exactly opposite each other during operation. However, when the pins 334, 336 become "out of phase" with respect to each other, the pivot shaft will also move to an extent determined by the degree to which the drive pins 334, 336 are out of phase. When the pivot shaft 345 moves back and forth, it moves the crank shaft 350 in steps and the clutches (only one 352 shown) come into play.

The threaded portion 320 moves the gear assembly 321 axially, under control of the handle or knob 324, and also causes the shafts 306, 318 to move in or out of phase with respect to their angular positions, as shown in solid lines of the two crank pins.

Screwing the threads on the member 320 relative to the gear 321 will cause the shaft 318 to become out of phase with respect to the shaft 306.

Figure 11:
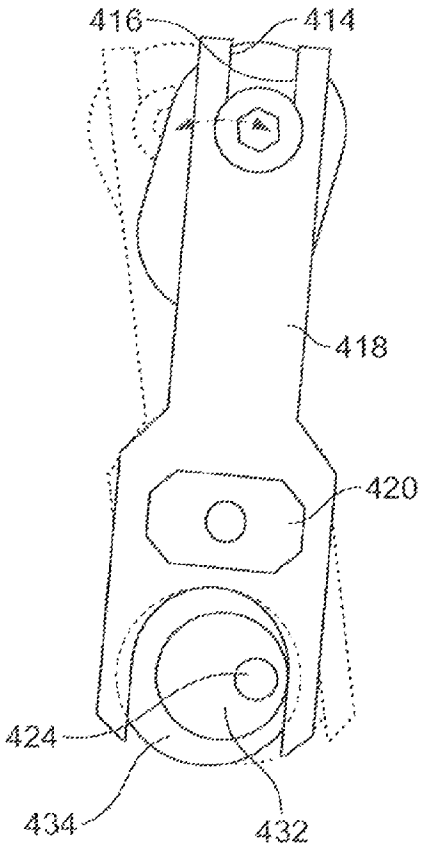
FIG. 11 is a front view of the yoke of FIG. 10, showing the yoke in a solid line and a phantom line position.
Figure 10:
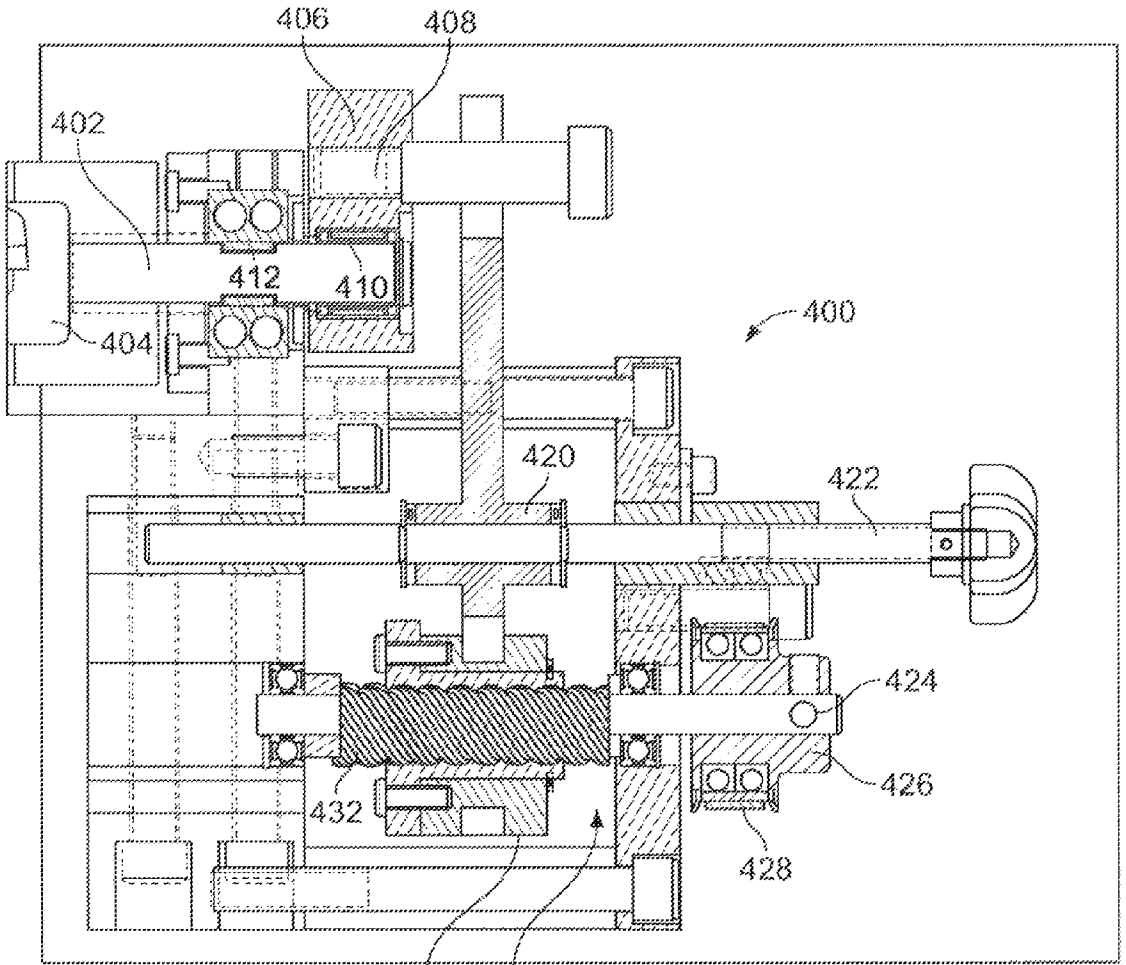
FIG. 10 shows a yoke and a drive mechanism with an adjuster for positioning the yoke from no stroke to full stroke; and showing the gear and shaft assemblies.

Referring now to FIGS. 10 and 11, there is shown a further variation 400 of the foregoing constructions. As with the other mechanisms, the idea is to drive the crankshaft 402 having a drive yoke 404 on its one end, with a series of intermittent motions or pulses. The housing 406 enclosing the pivot shaft 408 must be pushed back and forth so that the one-way clutches 410, 412 can convert the back and forth motion to an intermittent one way motion. To have a back and forth motion of the pivot shaft 408, the sides 414, 416 of the yoke 418 must engage the pivot shaft. For this purpose, the center portion 420 of the yoke 418 is mounted on the intermediate shaft 422.

The power for driving the main shaft 424 comes from the pulley 426 which in turn is driven by the belt 428. The countershaft has an eccentrically mounted assembly, generally designated 430, mounted on it, including a threaded sleeve 432 riding eccentrically on an axially movable core 434. Moving the core 434 moves the yoke 418, because the core 434 is asymmetrical. It moves as shown in FIG. 11. Here, the shaft 424 is shown in a fixed position, with the eccentrically mounted sleeve 432. The core 434 moves the sleeve 432, which in turn moves the yoke 420 axially.

A particular advantage in the ink pump arrangement of FIGS. 1-3 is that only a single motor is required for each of two drive shafts. The motor that can be used in such construction accordingly is a bidirectional stepper motor, i.e., it has steps of movement in both directions. This use of one motor for two pumps is particularly useful where there is very little space between zones.

Likewise, there is an advantage to having the two directional motions which the motor is capable of supplying, with a different amount of ink for each pump. For example, one pump may supply a large amount of ink, and a relatively small amount of ink from the other pump, or just as easily, it may provide large amounts from each one. The disadvantage is in cost, as such dual-directional motors are relatively quite expensive.

The apparatus of FIG. 4, has the advantage of being freely adjustable, merely by moving the control lever up or down, etc. Thus, each pump may have a adjustable amount of ink provided for it, and these adjustments may be done manually. However, they may also be done automatically, by having a motor associated with the lever arm 150, such as the motor 252 from FIG. 6.

The advantage of the construction of FIG. 5 is that only a single motor may be provided to run up to 4, or 24 pumps for every motor. However, owing to the fact that all the pump strokes occur at the same time, there may be a surging motion associated with this construction.

The advantage of the design of FIG. 8 is that it is capable of fine adjustment by moving the knob 344. Referring now to FIGS. 10 and 11, an advantage of that construction is that the movement of the pumping portion of the link arm is rather large compared to the movement of the eccentric end.

It will thus be seen that the present invention provides a series of novel methods and apparatus, which achieves its objects and advantages, including those pointed out and others which are inherent in the invention.

We claim:

1. An apparatus for feeding carefully controlled amounts of ink to the various zones of a printing press, said printing press being able to accommodate plural zones of printed material, said apparatus comprising:

plural oscillating intermittently driven ink pumps, each ink pump having:

a corresponding yoke coupled to an inner piston and an outer piston of said ink pump;

a corresponding oscillating drive shaft including a means for preventing ink flow backup, coupled to said yoke;

an eccentric housing enclosing a portion of said drive shaft;

a corresponding pivot shaft adapted to drive one of said drive shafts with intermittent motion, said pivot shaft partially enclosed within said eccentric housing and positioned eccentrically with respect to said drive shaft;

a link arm for each pivot shaft, said link arm having two pockets therein, a first pocket for engaging said pivot shaft and for driving said pivot shaft in back and forth swinging movements, with consequent one-way rotational movement of said drive shaft;

a means for driving said link arms by a motor operatively coupled to a second pocket of said link arm; and an ink adjustment, adjustable by movement of a fulcrum between stroking and non-stroking positions of said pivot shafts, thereby varying the amount of ink delivered by each pump.

2. An apparatus as defined in claim 1 wherein said means for preventing ink flow backup includes at least one one-way clutch for each drive shaft.

3. An apparatus as defined in claim 2 wherein there are provided two one-way clutches for each of said drive shafts.

4. An apparatus as defined in claim 1 wherein there are provided plural oscillating intermittently driven ink pumps, one ink pump for each of said zones.

5. An apparatus as defined in claim 1 wherein said motor is a stepper motor.

6. An apparatus as defined in claim 1 wherein each ink pump includes a positive driving connection between a motor and the ink pump, and said positive driving connection includes a toothed belt, and wherein each of said ink pump drive shafts includes a yoke shaft engaging said toothed belt.

7. An apparatus as defined in claim 1 wherein said link arms each comprise plastic sections having an opening.

8. An apparatus as defined in claim 1 wherein said link arms each comprise a metal section having openings.

9. An apparatus as defined in claim 1 wherein said link arms each comprise an elongated opening at one end, and at the other end, an elongated opening for receiving the pivot shaft and also for receiving the fulcrum, with the fulcrum link pin being movable, thereby changing the amount of movement by the pivot shaft.

10. An apparatus as defined in claim 1 wherein said link arm is in the form of a yoke, said yoke having a central pivot at the position of the fulcrum on the yoke and two opposed end portions, one of said end portions being adapted to engage a pivot shaft with a range of strokes, and the other end portion being driven by a shaft having an adjustable eccentric portion engaging said other end portion, said driven shaft having a variable degree of eccentricity with respect to said shaft.

11. An apparatus as defined in claim 1 wherein the two pockets, are driven by two rotary shafts, each shaft having a radial extension and a pin extending from said extension, and a center portion engageable with said pivot shaft, said center portion being adapted to move when said end portions are out of phase, and to remain free of movement when said end portions are in phase.

12. An apparatus as defined in claim 1 wherein said pivot shaft comprise a drive belt engaging pulley, said pulley being adapted to engage and drive said link arm.

13. An apparatus for feeding carefully controlled amounts of ink to the various zones of a printing press, said printing press being able to accommodate plural zones of printed material, said apparatus comprising:

plural rotary ink pumps, one for each of said zone, each ink pump including a pump driving mechanism comprising:

an eccentric housing;

a rotary drive shaft having an over-running clutch fitted in said eccentric housing and having a second over-running clutch external from said eccentric housing;

a pivot shaft fitted in said eccentric housing, positioned eccentrically from said drive shaft and adapted to drive said drive shaft;

a link arm for driving said pivot shaft, said link arm being adapted to create back and forth swinging movements of said pivot shafts, and one way only rotational movement of said drive shaft, said link arms adapted to be operatively coupled to, and driven by a motor; and an ink adjustment, that adjusts said link arms between stroking and non-stroking positions of said pivot shafts, thereby varying the amount of ink delivered by each pump.

* * * * *